US008590215B2

(12) United States Patent
Damichey

(10) Patent No.: US 8,590,215 B2
(45) Date of Patent: Nov. 26, 2013

(54) PREFABRICATED ELEMENT FOR A DWELLING UNIT

(76) Inventor: David Damichey, Magny Cours (FR)

( * ) Notice: Subject to any disclaimer, the term of this patent is extended or adjusted under 35 U.S.C. 154(b) by 404 days.

(21) Appl. No.: 12/809,507

(22) PCT Filed: Dec. 19, 2008

(86) PCT No.: PCT/FR2008/001798

§ 371 (c)(1),
(2), (4) Date: Jan. 4, 2011

(87) PCT Pub. No.: WO2009/106735

PCT Pub. Date: Sep. 3, 2009

(65) Prior Publication Data

US 2011/0088333 A1 Apr. 21, 2011

(30) Foreign Application Priority Data

Dec. 21, 2007 (FR) ..... 07/09020

(51) Int. Cl.

| | |
|---|---|
| ***E04B 1/04*** | (2006.01) |
| ***E04B 1/14*** | (2006.01) |
| ***E04B 1/348*** | (2006.01) |
| ***E04B 2/02*** | (2006.01) |
| ***E04C 2/288*** | (2006.01) |

(52) U.S. Cl.

USPC ..... 52/79.9; 52/284; 52/285.4; 52/309.12; 52/404.2; 52/405.1; 52/407.4; 52/584.1; 52/585.1

(58) Field of Classification Search

USPC ..... 52/79.9, 284, 285.4, 309.12, 322, 324, 52/326, 404.2, 405.1, 405.2, 407.3, 407.4

See application file for complete search history.

(56) References Cited

U.S. PATENT DOCUMENTS

| | | | | | |
|---|---|---|---|---|---|
| 1,819,405 | A | * | 8/1931 | Brooks | 52/584.1 |
| 1,834,892 | A | * | 12/1931 | Betzler | 52/284 |
| 2,114,048 | A | * | 4/1938 | Davis | 52/475.1 |
| 2,592,634 | A | * | 4/1952 | Hart | 52/584.1 |
| 3,621,626 | A | | 11/1971 | Tylius | |
| 3,641,724 | A | * | 2/1972 | Palmer | 52/793.11 |
| 3,919,824 | A | * | 11/1975 | Davis, Jr. | 52/689 |
| 3,979,863 | A | * | 9/1976 | Hurley et al. | 52/92.1 |
| 4,291,513 | A | * | 9/1981 | Ankarswed | 52/284 |
| 4,542,613 | A | * | 9/1985 | Leyte-Vidal | 52/375 |

(Continued)

FOREIGN PATENT DOCUMENTS

| | | | |
|---|---|---|---|
| DE | 2241841 | A1 | 3/1974 |
| DE | 3413305 | A1 | 10/1984 |

(Continued)

*Primary Examiner* — Robert Canfield

(74) *Attorney, Agent, or Firm* — Quarles & Brady LLP

(57) ABSTRACT

This invention relates to a prefabricated element (1) for a dwelling unit that is notable in that it comprises: a vertical wall (2) of approximately constant thickness comprising a front face (3), a rear face (4) and a peripheral face (5); a first lip (6) along each horizontal edge of said front face (3); a second lip (7) down each vertical edge of said front face (3); first and second ribs (8, 9) forming with the first and second lips (6, 7) a grid of cells (10) suitable for filling with insulating materials (11) and accepting an interior trim (14) to mask the entire grid; a peripheral edging (23) creating at least one bearing face and a barrier buffer; and at least first and second fixing members (20, 21) for connecting the prefabricated elements (1) to each other.

18 Claims, 8 Drawing Sheets

(56) References Cited

U.S. PATENT DOCUMENTS

| | | | | |
|---|---|---|---|---|
| 4,841,702 | A * | 6/1989 | Huettemann | 52/309.12 |
| 4,942,707 | A * | 7/1990 | Huettemann | 52/259 |
| 5,313,753 | A * | 5/1994 | Sanger | 52/251 |
| 5,317,848 | A * | 6/1994 | Abbey | 52/284 |
| 5,381,635 | A * | 1/1995 | Sanger | 52/251 |
| 5,433,049 | A * | 7/1995 | Karlsson et al. | 52/293.2 |
| 5,956,911 | A * | 9/1999 | Kistner et al. | 52/302.3 |
| 6,003,278 | A * | 12/1999 | Weaver et al. | 52/414 |
| 6,388,231 | B1 * | 5/2002 | Andrews | 219/121.69 |
| 6,427,406 | B1 * | 8/2002 | Weaver et al. | 52/414 |
| 6,463,702 | B1 * | 10/2002 | Weaver et al. | 52/79.1 |
| 6,698,150 | B1 * | 3/2004 | DiLorenzo | 52/414 |
| 7,739,844 | B2 * | 6/2010 | Gharibeh et al. | 52/309.8 |
| 7,958,687 | B2 * | 6/2011 | Dilorenzo | 52/319 |
| 2005/0262786 | A1 * | 12/2005 | Messenger et al. | 52/309.12 |
| 2007/0144093 | A1 * | 6/2007 | Messenger et al. | 52/309.12 |

FOREIGN PATENT DOCUMENTS

| | | | |
|---|---|---|---|
| DE | 20215395 | U1 | 3/2003 |
| FR | 2 925 541 | A1 * | 9/2009 |
| WO | WO 01/42575 | A1 * | 6/2001 |

* cited by examiner

PREFABRICATED ELEMENT FOR A DWELLING UNIT

The present invention relates to a prefabricated element made of composite building material produced from crushed aggregate agglomerated by a binder such as high performance concrete for example, to an industrial, commercial or individual dwelling unit which is the result of assembling a plurality of said prefabricated elements, and also to associated manufacturing and assembly methods.

High performance concrete is understood here to be a concrete which has a mechanical strength under compression of a minimum of around 60 MPa (megapascals), as measured conventionally on cylindrical test specimens measuring 16×32 mm.

The use of prefabrication is necessary in order to achieve a reduction in the manufacturing costs, a guarantee of quality with a view to reducing the impact on the environment and above all consistency of this quality across all the products of a building firm, and also to achieve better working conditions for the workers involved in the construction of buildings.

In order to obtain the anticipated results, uniform dwelling units obtained from prefabricated elements must be manufactured. This uniformity is one of the conditions of standardization, and therefore of reducing the manufacturing costs, and it is at a maximum when a structure can be reduced to an assembly of identical units incorporating the greatest possible amount of equipment.

In the field of prefabricated dwelling units, numerous modular structures, such as for example Algeco (registered trademark) modules produced mostly from a metallic structure, are already known. These modular structures, conforming to the road loading gage, are used separately or assembled, temporarily or permanently, and are commonly used as barracks, offices or machine rooms.

However, the standardization of these dwelling units greatly limits creative imagination and as a result is not employed for structures intended, if not to be original, at least to be individual.

In addition, known modular units, which have a reduced surface area of around 20 $m^2$ in order to be able to be transported easily by road, only rarely meet the requirements of stability over time with respect both to their esthetic and their functional characteristics, such as for example their fire behavior and in particular their fire stop duration.

Finally, extending a building produced with said known dwelling units both horizontally and vertically proves to be difficult and often expensive.

A concrete building panel, such as that described in the international patent application WO 01/42575, is also known. This element comprises a plate provided with upper and lower flanges which generally define a box, and also a plurality of ribs extending between the upper and lower flanges, parallel to the lateral flanges, and can be used in the building of the walls, the floor or the roof of a building. However, this panel has no sealing members or reinforced mechanical characteristics.

One of the aims of the present invention is to remedy these various drawbacks by providing a prefabricated element made of composite building material produced from crushed aggregate agglomerated with a binder such as high performance concrete for example and including as much equipment as possible; said prefabricated element, which has good acoustic and thermal mechanical characteristics, can be assembled with other similar elements in order to form a modular dwelling unit.

In this respect, the subject of the present invention is a prefabricated element for a dwelling unit made mainly of composite building material produced from crushed aggregate agglomerated with a binder, the prefabricated element being noteworthy in that it comprises:

- a vertical partition of approximately constant thickness and having a front face, a rear face and a peripheral face,
- a first flange along each horizontal edge of said front face,
- a second flange along each vertical edge of said front face,
- first and second ribs which are respectively vertical and horizontal and form with the first and second flanges a grid of cells filled with insulating materials and able to hold an interior trim concealing the entirety of said grid,
- a peripheral shoulder designed to transmit and distribute service loads and creating at least one bearing face and a sealing baffle, and
- at least first and second fixing members enabling various prefabricated elements to be assembled together.

Said prefabricated element is also noteworthy in that the vertical faces of the first and second flanges, the first and second ribs, which are approximately parallel to the front face of the partition, are covered with first battens for fixing said interior trim and the insulating materials.

The design of the present invention furthermore enables an increase in the mechanical strength and a significant saving of weight.

Another subject of the present invention is a standardized modular dwelling unit consisting of prefabricated elements, having a surface area of around 35 $m^2$ and able both to be handled and transported individually on edge and to be assembled one by one in a horizontal or vertical direction in order to obtain a dwelling or a building having a large surface area.

According to another feature of the invention, the dwelling units may have different levels of finish, both inside and outside, thus making it easier to personalize the dwelling.

Finally, other subjects of the present invention are, firstly, the method of producing said prefabricated elements and, secondly, the method of assembling said dwelling units.

Further advantages and features will become more apparent from the following description of a nonlimiting exemplary application of the prefabricated element in a dwelling unit, with reference to the appended drawings, in which.

In this nonlimiting exemplary embodiment, a longitudinal prefabricated element according to the invention, comprising a first, generally rectangular and large opening corresponding to a recess for a complete double French window (door frame and leaves) and a second, generally rectangular and small opening corresponding to a recess for a complete single window (window frame and casements), will be described; however, the number, form and dimensions of these first and second openings could be adapted to the wishes of the customer.

Figure 1:
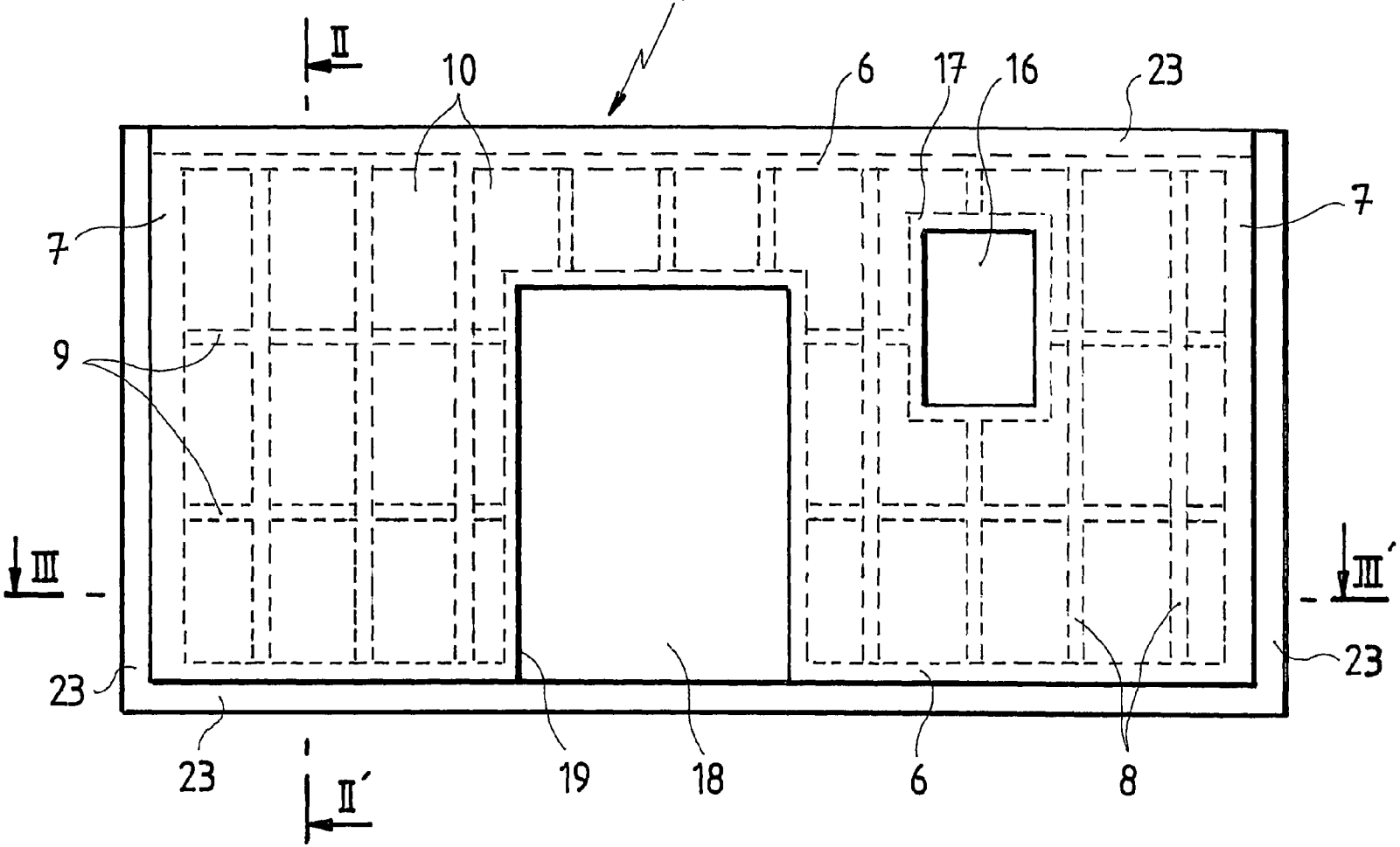
FIG. 1 is a front view of a prefabricated element in accordance with the invention.
Figure 2:
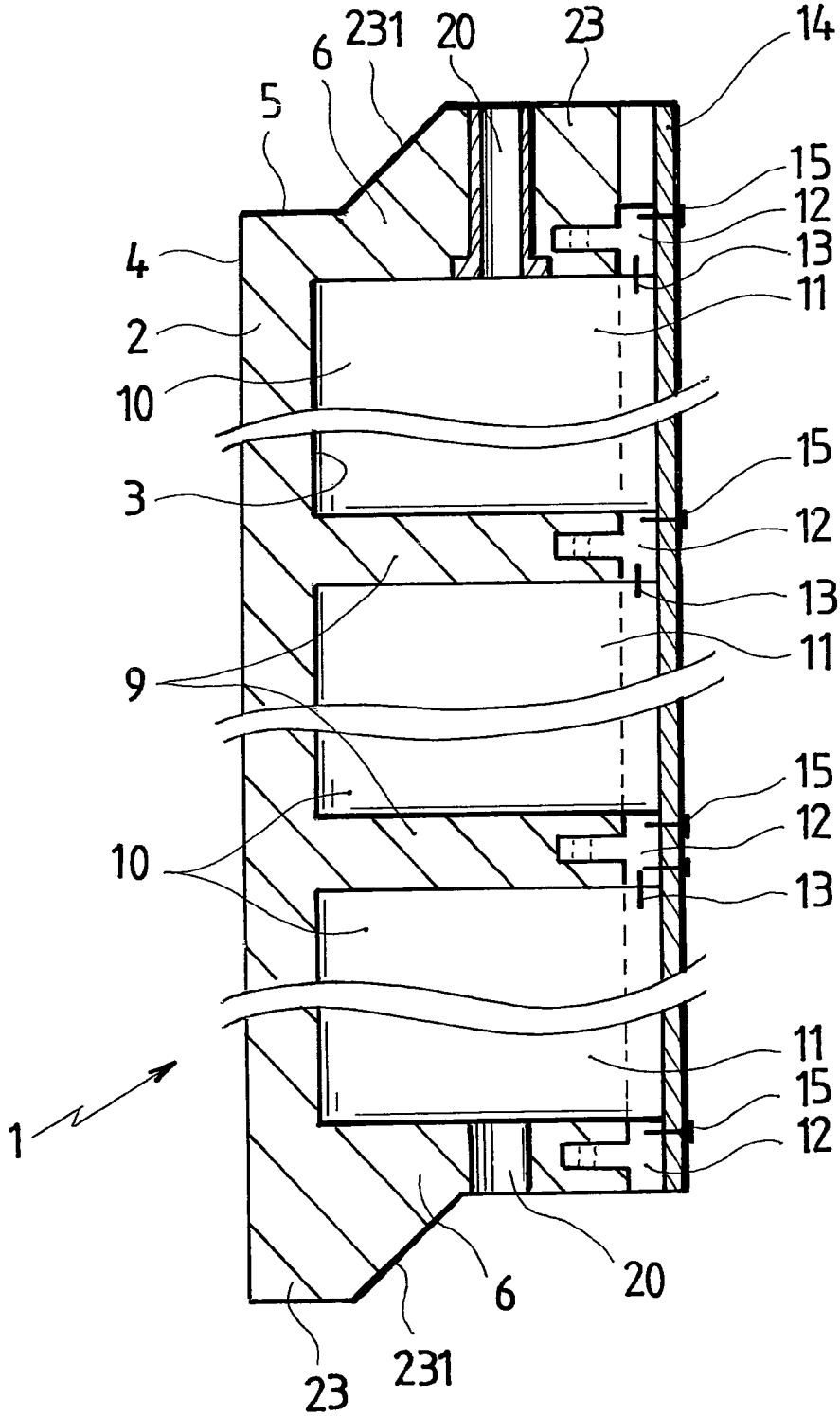
FIG. 2 is a partial view in vertical section on the axis II-II' of a prefabricated element shown in FIG. 1.
Figure 3:
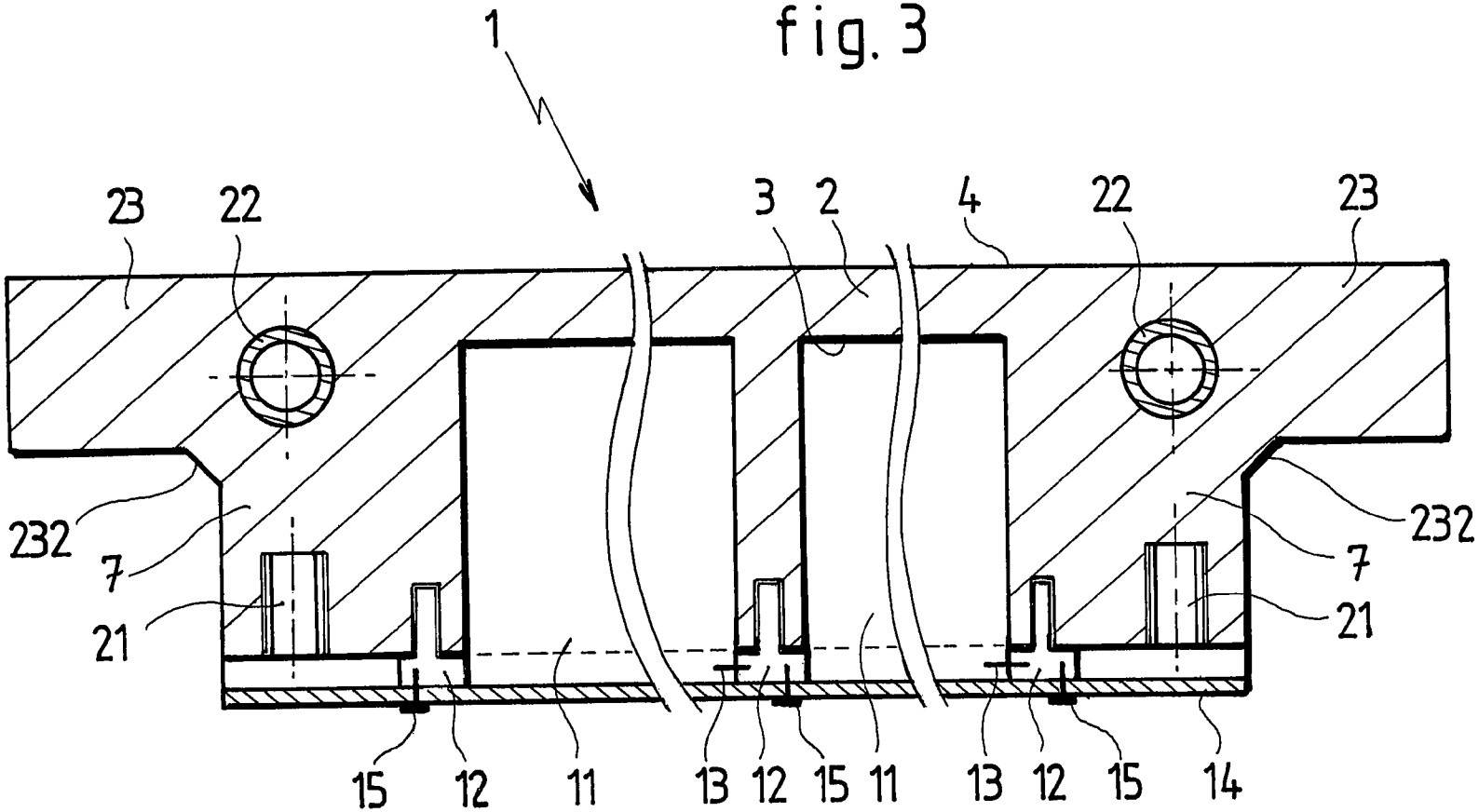
FIG. 3 is a partial view in horizontal section on the axis III-III' of a prefabricated element shown in FIG. 1.
Figure 4:
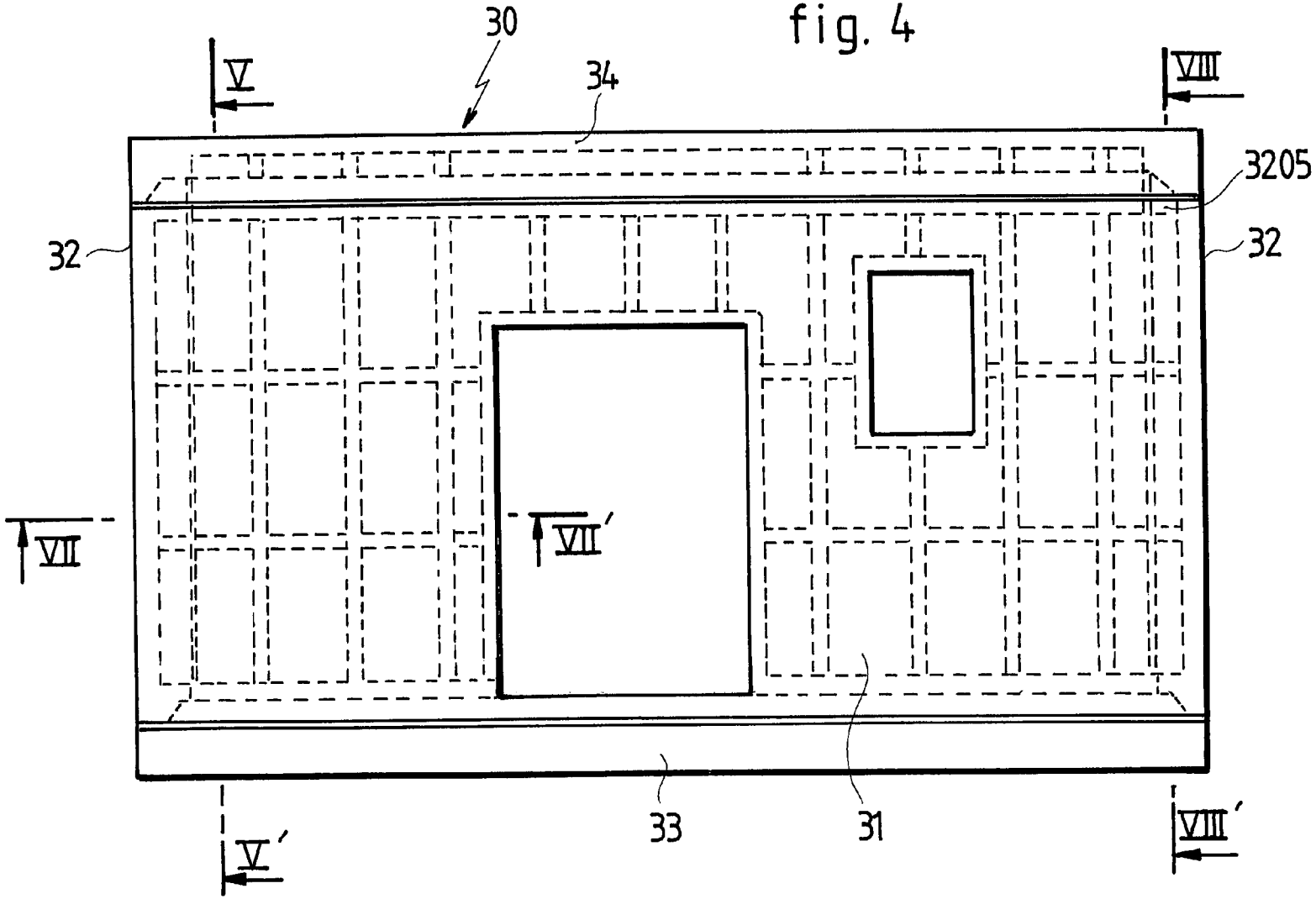
FIG. 4 is a front view of the outside of a dwelling unit in accordance with the invention.
Figure 5:
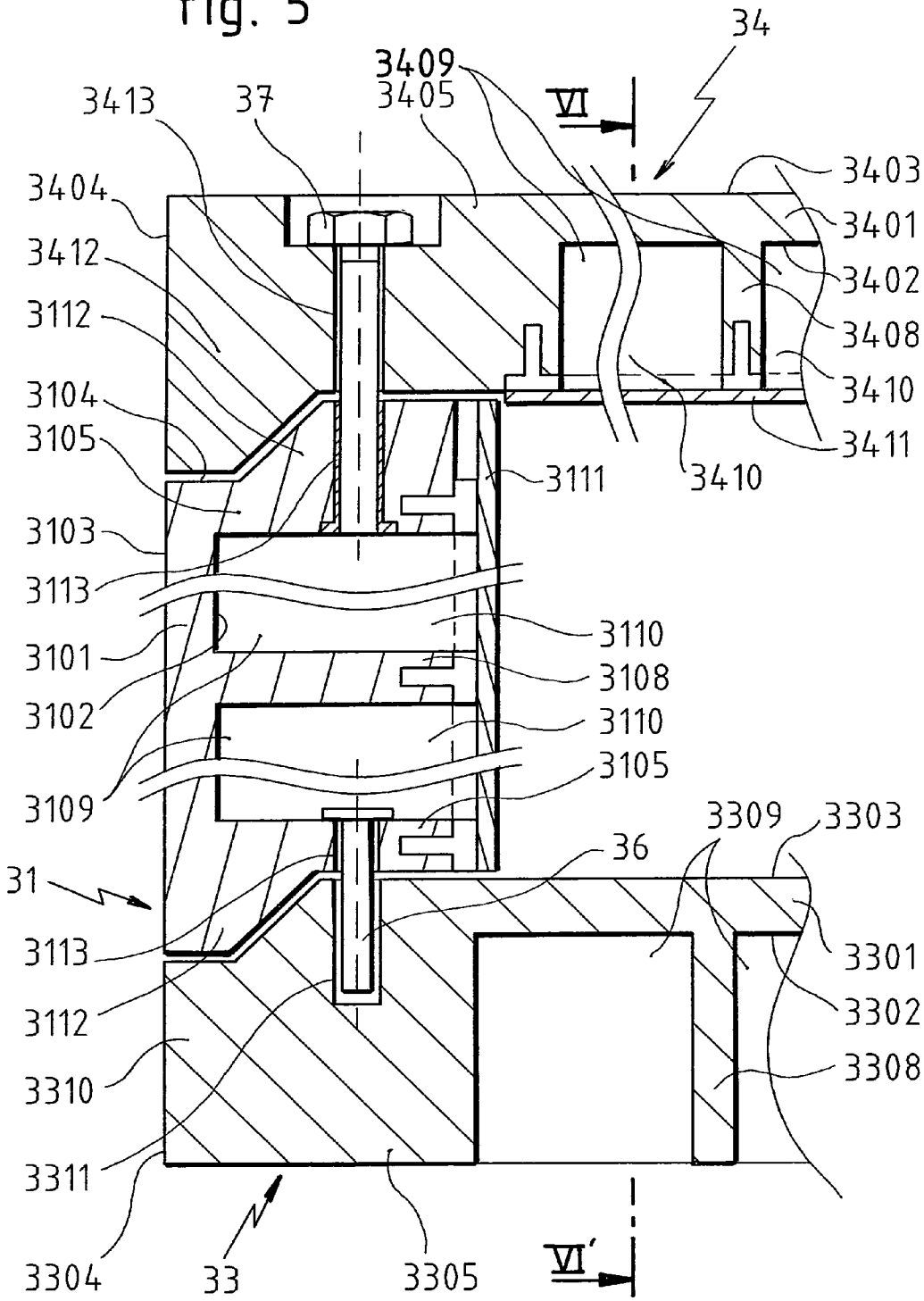
FIG. 5 is a partial view in vertical section on the axis V-V' of the dwelling unit shown in FIG. 4.
Figure 6:
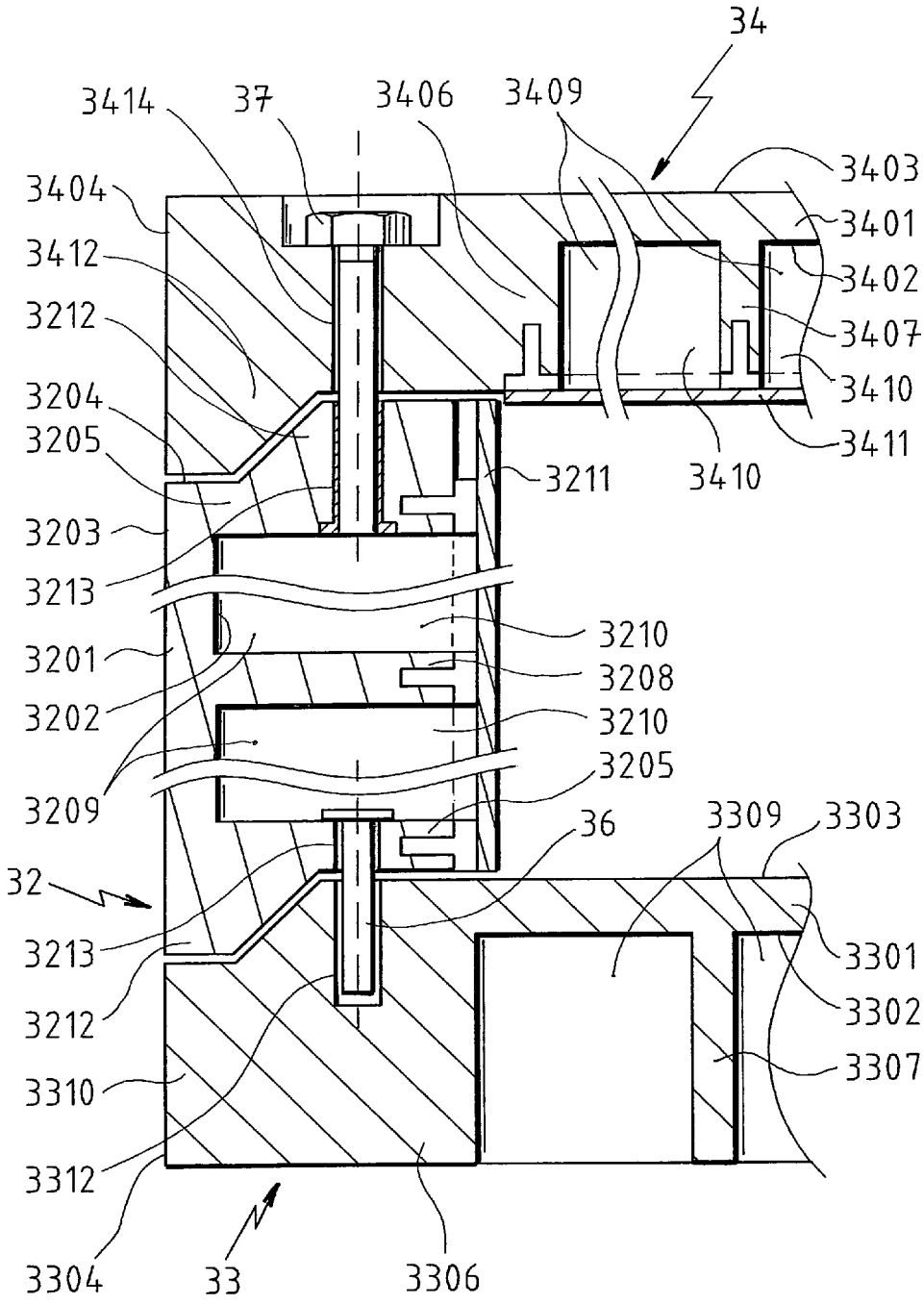
FIG. 6 is a partial view in vertical section on the axis VI-VI' of the dwelling unit shown in FIG. 5.
Figure 7:
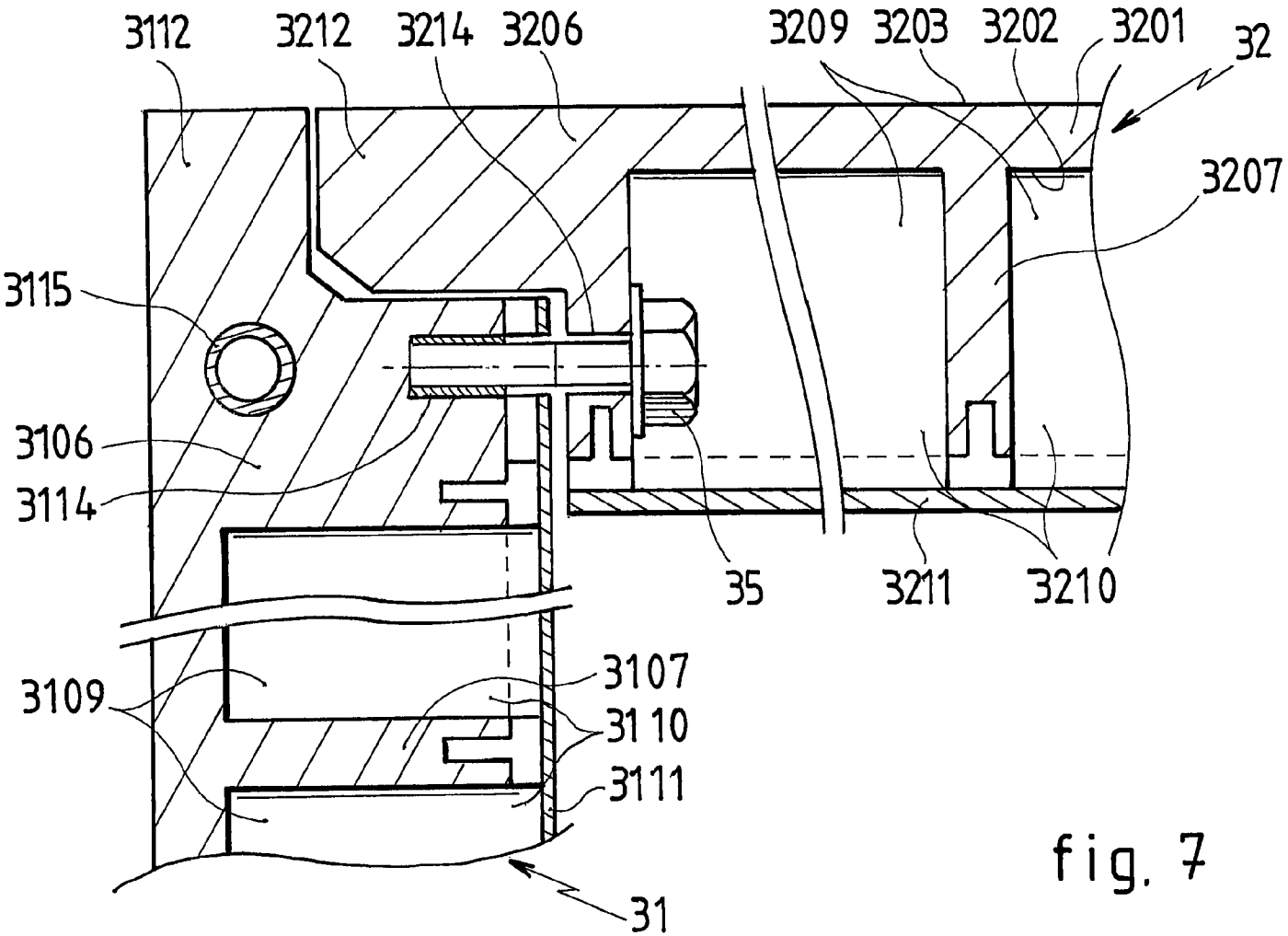
FIG. 7 is a partial view in horizontal section on the axis VII-VII' of the dwelling unit shown in FIG. 4.
Figure 8:
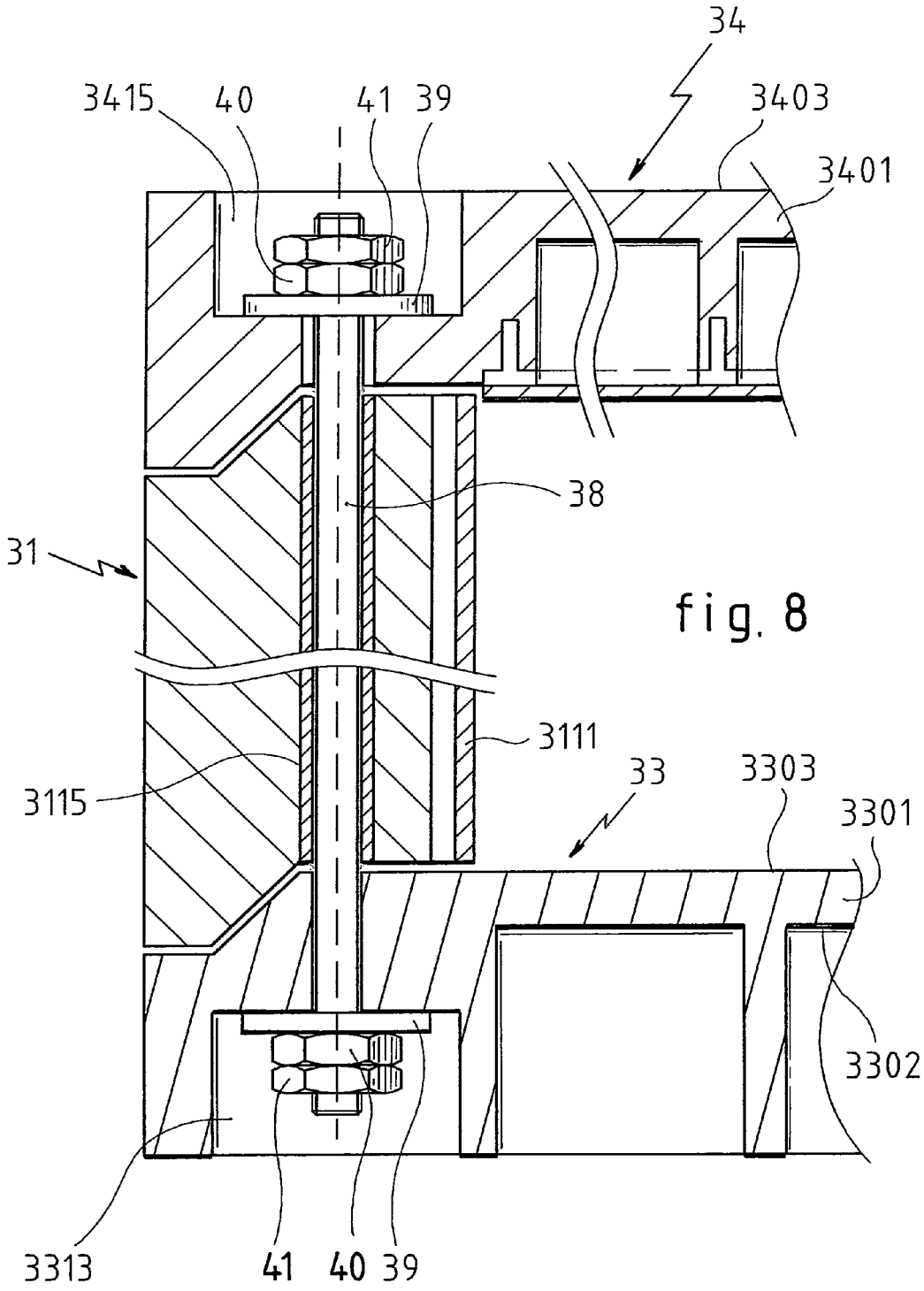
FIG. 8 is a partial view in vertical cross section on the axis VIII-VIII' of the dwelling unit shown in FIG. 4.

With reference to FIGS. 1 to 3, the generally rectangular longitudinal prefabricated element 1 consists of a vertical partition 2 of approximately constant thickness and having a front face 3, a rear face 4 and a peripheral face 5; a first horizontal flange 6 protruding perpendicularly from the front face 3 along each horizontal edge of said front face 3; a second vertical flange 7 protruding perpendicularly from the front face 3 along each vertical edge of said front face 3; first vertical ribs 8 protruding perpendicularly from the front face 3 of said partition and connecting the two first flanges 6; and two horizontal ribs 9 protruding perpendicularly from the front face 3 of said partition 2 and connecting two consecutive first ribs 8 and a first rib 8 to a second flange 7.

The first and second flanges 6, 7 and the first and second ribs 8, 9 form an advantageously regular grid of generally parallelepipedal cells 10.

The first and second flanges 6, 7 and the first and second ribs 8, 9, which have generally rectangular cross sections, advantageously have the same height such that their faces parallel to the front face 3 of the partition 2 form a plane approximately parallel to said front face 3.

The height of the various elements protruding from the front face 3 is understood to be the dimension in a direction perpendicular to said front face 3, and the width is understood to be the dimension in a direction parallel to said front face 3.

In order to increase the acoustic and thermal insulation of the prefabricated element, said cells 10 are filled with an insulating material 11. For reasons of integrity over time and ease of fitting, said insulating material 11 is preferably a preformed insulation block such as expanded foam for example.

Of course, the insulating material 11 can be replaced by any other thermal and acoustic insulation, such as mineral wool, polystyrene or cellulose wadding, or by any other material having similar effects or by superposing different materials.

The partition 2, the first and second flanges 6, 7 and the first and second ribs 8, 9 are made of composite building material produced from crushed aggregate agglomerated with a binder such as high performance concrete for example.

The vertical faces of the first and second flanges 6, 7 and the first and second ribs 8, 9, which are approximately parallel to the front face 3 of the partition 2, are covered with first battens 12, advantageously made of wood or MDF (medium density fiberboard) or the like. In order to make it easier to connect said first battens 12 to the composite building material and to reinforce this connection, said first battens 12 are preferably in the general form of an inverted T, of which the central stalk, which is embedded in said building material, is perforated. The part formed by the arms of the T holds the first fixing means 13 for holding said insulating materials 11 in position. Preferably, the first fixing means 13 are pins for fixing said insulating materials 11 on the first battens 12, but they could obviously be replaced by any other similar fixing means, such as adhesive for example.

The first battens 12 also enable the fitting of an interior trim 14 concealing the entirety of the grid of cells 10 and the insulating materials 11 and enabling if appropriate the positioning of a decorative wall coating such as wallpaper or paint for example. Said battens 12 are also used to break the thermal bridge between the grid of cells 10 and said interior trim 14. Said interior trim 14 is preferably in the form of sheets of gypsum plasterboard, wood or the like, pressed and fixed on the first battens 12 via second fixing means 15. Said second fixing means 15 are advantageously nails or wood screws.

In order to limit the cutting of the sheets of interior trim 14 and for there always to be a junction between two sheets of interior trim 14 pressing against a first batten 12, the distance between the middle of two first ribs 8 will advantageously be a submultiple of the width of one of said sheets of interior trim 14.

In the exemplary embodiment described, the prefabricated element 1 comprises a first, generally rectangular and small opening 16 passing from one side of the partition 2 to the other. Said first opening 16 comprises a third flange 17 protruding perpendicularly from the front face 3 of said partition 2 along the periphery of said first opening 16. The third flange 17 has a generally rectangular cross section and preferably has a cross section identical to that of the first and second ribs 8, 9. Thus, the vertical face of said third flange 17, which is parallel to said front face 3, is covered with a second batten which is advantageously identical to the first battens 12 and enables, in particular, sheets of interior trim 14 to be fixed around said first opening 16 via the second fixing means 15.

In addition, said first opening 16 is able to hold and fix a complete single window (window frame and casements), which is not shown.

In the exemplary embodiment described, the prefabricated element 1 also comprises in its lower part a second, generally rectangular and large opening 18 passing from one side of the partition 2 to the other and opening onto the lower horizontal flange of the assembly comprising the partition 2 and the first flange 6. By analogy with the first opening 16, the second opening 18 has a fourth flange 19 protruding perpendicularly from the front face 3 along the upper horizontal edge and the vertical edges of said second opening 18 and covered with third battens enabling sheets of interior trim 14 in particular to be fixed around said second opening 18 via the second fixing means 15.

Said second opening 18 is able to hold and fix a complete double French window (door frame and leaves), which is not shown.

The third and fourth flanges 17, 19 are made of composite building material produced from crushed aggregate agglomerated with a binder such as high performance concrete for example.

It goes without saying that, for obvious reasons of simplifying the structure of the prefabricated element 1, said first and second openings 16, 18 could, as far as possible, be arranged in line with the first and/or second ribs 8, 9, in order to prevent some or all of the third and fourth flanges 17, 19 from being present.

A person skilled in the art could do away with the first, second and third battens 12 by gluing the sheets of interior trim 14 to insulating materials 11 and by fixing the assembly thus obtained directly to the first and second ribs 8, 9 via pegs for example, without departing from the scope of the present invention. However, with this design, the thermal bridge between the grid of cells 10 and the sheets of interior trim 14 is not broken.

Furthermore, the first and second flanges 6, 7 respectively have first and second fixing members 20, 21 for assembling a vertical prefabricated element 1 together with a similar horizontal or vertical element. For reasons of simplicity, said first and second fixing members 20, 21 are advantageously:

- either female members, for example sockets having threaded holes and inserted into said first and second flanges 6, 7,
- or plain holes enabling the passage of male members, for example screws able to engage with said first and/or second female fixing members 20, 21.

It is clear that, in order to assemble two prefabricated elements 1 together, it is necessary for one to have first and/or second female fixing members 20, 21 and the other to have plain holes.

Similarly, it is clear that the plain holes must have counterbores in order to embed the head of the male members and to have flat surfaces without any apparent irregularities.

It goes without saying that a person skilled in the art could replace the first and/or second above described fixing members 20, 21 with other similar members that have the same effects. Thus, he could use male members of the anchoring nail type that engage with a blind hole filled with chemical resin when the prefabricated elements 1 are assembled together.

In addition, in order to assemble a vertical prefabricated element 1 between two horizontal prefabricated elements 1, the second flanges 7 are able to hold third fixing members 22. Said third fixing members 22 enable said composite building material to be post-stressed and comprise in particular linings enabling the later fitting for example of a threaded rod following the manufacture of the prefabricated element 1 in order to assemble said vertical prefabricated element 1 between two other similar horizontal prefabricated elements.

It is clear that, for very long prefabricated elements 1 and/or those having a large number of openings, it is possible, without departing from the scope of the present invention, to add additional intermediate third fixing members 22, for example in a double-width first rib 8, in order to increase the mechanical strength of said prefabricated element 1 during assembly.

On the other hand, given the position of the third fixing means 22 (at the vertical ends of the prefabricated element 1), it goes without saying that only one of the two prefabricated elements 1 assembled together has to be provided with said third fixing means 22.

Finally, the prefabricated element 1 thus produced also comprises a shoulder 23 creating at least one bearing face enabling both the assembling together of different prefabricated elements 1 and the fitting of sealing at the junction between the different prefabricated elements 1 by creating a sort of baffle.

Said shoulder 23 protrudes perpendicularly from the peripheral face 5 of said prefabricated element 1. In addition, said shoulder 23 is advantageously positioned firstly on the vertical sides and the lower horizontal side along the edges of said peripheral face 5, these edges being located next to the rear face 4 of the partition 2, and secondly on the upper horizontal side along the edge of said peripheral face 5, this edge being located next to the first flange 6 of the prefabricated element 1. The effect of this design, when the prefabricated element 1 is assembled together with other similar elements in order to form a dwelling unit, is to form a baffle and thus prevent rainwater from penetrating through.

In addition, the shoulder 23 is present around the entire periphery of the prefabricated element 1 and is designed, depending on its location, as a post or a beam, thereby ensuring good mechanical strength of the prefabricated element 1, especially in line with an opening similar to said second opening 18, in particular during handling operations of said prefabricated element 1.

The shoulder 23 is made of composite building material produced from aggregate agglomerated with a binder such as high performance concrete for example.

The shoulder 23 has, furthermore, inclined parts 231 and/or beveled parts 232 in order, firstly, to make it easier to assemble the prefabricated elements together and, secondly, optionally to fit a seal for increasing sealing between the different prefabricated elements 1.

The prefabricated element 1 thus produced can be handled either by using the first and/or second fixing members 20, 21, or by using handling members (not shown), such as slings, lifting pins or other similar members having the same effects. The handling members may furthermore be removable or not removable.

Finally, the prefabricated element 1 has ducts (not shown) for the various services (electricity, water, gas, etc.) located between the partition 2 and the interior trim 14. Similarly, the element may, depending on the selected level of finish, be delivered with fully installed electrics, doors, windows, shutters, interior and exterior paintwork, tiling, cladding, etc.

The design of the prefabricated element 1 with a grid of cells 10 and the use of high performance concrete make it possible to increase the mechanical strength and make a significant saving of weight with respect to traditional reinforced concrete.

Another subject of the present invention is the method of manufacturing said prefabricated element 1, comprising the following steps in succession:

- installing, on a pattern board, formwork elements delimiting the perimeter of the prefabricated element 1 and forming the peripheral shoulder 23;
- fitting various battens 12 in line with the various flanges 6, 7, 17, 19 and in order to delimit the grid of cells 10;
- fitting the blocks of insulating material 11 fixed on the various battens 12 via first fixing means 13 in order to form the first and second ribs 8, 9;
- fitting the first, second and third fixing members 20, 21, 22 and, if appropriate, lifting means; and
- pouring the composite building material, followed by the removal of the formwork.

It is clear that if the prefabricated element 1 has openings, it is necessary to insert the following step before the step of fitting the various battens:

- fitting recesses for the various openings 16, 18.

Depending on the needs and/or the level of finish, following the step of pouring and removal of the formwork, the following steps could be added:

- tracing and boring reserve channels for the ducts for the various services;
- installing the ducts, refilling the channels and identifying said channels with, for example, conventional colors;
- installing and fixing the interior trim 14 on said first, second and third battens 12, 17 and 19;
- various finishes (paintwork, electricity, doors, windows, etc.).

A further subject of the present invention is a standard modular dwelling unit 30 consisting of prefabricated elements similar to the prefabricated element 1 described hereinabove.

With reference to FIGS. 4 to 7, said dwelling unit 30 has two longitudinal elements 31, two lateral elements 32, a lower floor 33 and an upper floor 34.

In a similar way to the prefabricated element 1 described hereinabove, the two longitudinal elements 31, the two lateral elements 32, the lower floor 33 and the upper floor 34 respectively comprise:

- a partition 3101, 3201, 3301, 3401 (which is horizontal for the floors and vertical for the longitudinal and lateral elements) of approximately constant thickness and comprising a front face 3102, 3202, 3302, 3402, a rear face 3103, 3203, 3303, 3403 and a peripheral face 3104, 3204, 3304, 3404;

first flanges 3105, 3205, 3305, 3405 and second flanges 3106, 3206, 3306, 3406; and first ribs 3107, 3207, 3307, 3407 and second ribs 3108, 3208, 3308, 3408 forming a grid of cells 3109, 3209, 3309, 3409.

Said longitudinal elements 31, which are strictly identical to the prefabricated element 1 described hereinabove, have their grid of cells 3109 directed toward the interior of the dwelling unit 30, filled with insulating materials 3110 and covered with a trim 3111.

Moreover, said longitudinal elements 31 have a shoulder 3112 protruding perpendicularly from the peripheral face 3104 of said longitudinal elements 31.

Said longitudinal elements 31 are likewise equipped with first and second fixing members 3113, 3114. Said first fixing members 3113 advantageously consist of female members inserted perpendicularly to the peripheral face 3104 into the first upper flange 3105 and of plain holes passing from one side of the first upper flange 3105 to the other, perpendicularly to the peripheral face 3104. Said second fixing members 3114 are advantageously female members inserted perpendicularly to the front face 3102 into the second flanges 3106.

Said longitudinal elements 31 are also equipped with third fixing members 3115 having a lining, such as for example a tube inserted into the second flanges 3106 and passing vertically from one side of said second flanges 3106 to the other.

In a similar way to the longitudinal elements 31, the two lateral elements 32 have their grid of cells 3209 directed toward the interior of the dwelling unit 30, filled with insulating materials 3210 and covered with a trim 3211.

Similarly, said lateral elements 32 have a shoulder 3212 protruding perpendicularly from the peripheral face 3204 of said lateral elements 32.

Finally, said lateral elements 32 are likewise equipped with first and second fixing members 3213, 3214. Said first fixing members 3213 advantageously consist of female members inserted perpendicularly to the peripheral face 3204 into the first upper flange 3205 and plain holes passing from one side of the first upper flange 3205 to the other, perpendicularly to the peripheral face 3204. Said second fixing members 3214 are consequently preferably plain holes passing widthwise from one side of the second flanges 3206 to the other, enabling the passage of first male members 35 engaging with the second fixing members 3114 of said longitudinal elements 31.

On the other hand, unlike the prefabricated element 1, the cells 3309 of the lower floor 33 are located toward the bottom of the exterior side of the dwelling unit 30 in order to have a flat and solid surface inside said dwelling unit 30 enabling the fitting of a floor covering of the tiling or parquet type, etc.

Furthermore, the lower floor 33 has a peripheral shoulder 3310 protruding perpendicularly from the peripheral face 3304 of said lower floor 32. However, unlike the prefabricated element 1 described hereinabove, said shoulder 3310 is positioned at the end of the first and second flanges 3305, 3306 on the four sides of the lower floor 33, in order to have a flat and continuous bearing zone around the entire periphery of said lower floor 33 in order to make it possible to absorb and distribute loads.

It is clear that in this design, it will not be necessary to fit the various battens or a trim, but rather just to fill the cells 3309 with insulating materials in order to thermally insulate said lower floor 33, since the first and second flanges 3305, 3306 and the first and second ribs 3307, 3308 are in direct contact with the foundations or the earthwork.

Said lower floor 33 is further equipped with first and second fixing members 3311, 3312. Said first and second fixing members 3311, 3312 are advantageously female members inserted into the first and second flanges 3305, 3306 and are advantageously blind holes made in the first and second flanges 3305, 3306 perpendicularly to the rear face 3303 of the partition 3301. Said first and second fixing members 3311, 3312 are able firstly to engage with second male members 36 such as anchoring nails and secondly to be filled with chemical resin in order to fix the second male members 36. Said second male members 36 fix the longitudinal and lateral elements 31, 32 on the lower floor 33 by engaging with the first lower fixing members 3113, 3213 of the longitudinal and lateral elements 31, 32.

In addition, the lower floor 33 has recesses 3313 able to engage with the second fixing members 3115 of the longitudinal elements 31 of said dwelling unit 30.

Finally, the lower floor 33 has, if appropriate, orifices (not shown) in the thickness of its partition 330, passing from one side of said partition 3301 to the other, enabling the fitting of assembly means (not shown), such as for example threaded rods and nuts in order to assemble two dwelling units 30 together.

The upper floor 34 is such that its cells 3409 are oriented downward and consequently on the inside of the dwelling unit 30 in order to have a flat and solid surface on the exterior of said dwelling unit 30 for attic spaces, a roof or even a flat roof.

In a similar way to the longitudinal and lateral elements 31, 32, the upper floor 34 has its grid of cells 3409 filled with insulating materials 3410 and covered with a trim 3411 enabling, if appropriate, the positioning of a decorative wall coating.

Given the position of the upper part of the respective shoulders 3112, 3212 of said longitudinal and lateral elements 31, 32, the upper floor 34 advantageously has a peripheral shoulder 3412 which is a continuation of the end of the first and second flanges 3405, 3406 along a perpendicular to said partition 3401. Said shoulder 3412, by engaging with the upper part of the respective shoulders 3112, 3212 of said longitudinal and lateral elements 31, 32, prevents rainwater from penetrating through and makes it possible to obtain very good sealing and the transmission of loads due in particular to snow, wind, the roof or even an upper story.

Said upper floor 34 is further equipped with first and second fixing members 3413, 3414. Said first and second fixing members 3413, 3414 are advantageously plain through-holes made in the first and second flanges 3405, 3406 perpendicularly to the rear face 3403 of the partition 3401. Said first and second fixing members 3413, 3414 enable the passage of the third male members suitable for engaging with the first upper fixing members 3113, 3213 of the longitudinal and lateral elements 31, 32.

In a similar way to the lower floor 33, the upper floor 34 also has recesses 3415 able to engage with the third fixing members 3115 of the longitudinal elements 31 of said dwelling unit 30 and enabling the fitting of the fourth male members 38, preferably a threaded rod, distribution plates 39, female tightening members 40 and members 41 for immobilizing said female members 40 in order to perform post-stressing.

It goes without saying that a person skilled in the art could replace the immobilizing members 41 with any other means for locking the female members 40, such as welding, without departing from the scope of the present invention.

Once the various parts are prefabricated, said parts must be assembled in order to build the dwelling unit 30 in accordance with a well defined method which makes the operation irreversible and permanent. This is because it is only at the end of the assembly process that the dwelling unit 30 becomes inseparable and self-supporting.

Due to their respective grids of cells 3109, 3209, 3309, 3409 and their peripheral shoulders 3112, 3212, 3310, 3412, the longitudinal and lateral elements 31, 32, the lower floor 33 and the upper floor 34 form individual mechanical matrices which are certainly stable for questions of prefabrication and handling, but once adhesive-coated and assembled, the qualities of these various elements add up and give the unit the quality of being self-supporting. Adhesive-coating with an epoxy resin reinforced by assembling makes the action irreversible and permanent. The dwelling unit 30 is then inseparable.

Another subject of the present invention is thus the method, firstly, of building said dwelling unit 30 from the elements described above and, secondly, of assembling various dwelling units 30 together, comprising the following steps in succession:

- installing a lower floor 33 on a flat horizontal surface such as a plate;
- fitting a longitudinal element 31 on the lower floor 33 by bringing the shoulders 3112, 3310 into contact and by applying adhesive or resin beforehand to the contact surfaces;
- putting resin and then second male members 36 into the first fixing members 3311 for assembling together the longitudinal element 31 and the lower floor 33;
- fitting a lateral element 32 on the lower floor 33 by bringing the shoulders 3212, 3310 into contact and by applying adhesive beforehand to the contact surfaces;
- putting resin and then second male members 36 into the first fixing members 3311 for assembling together the lateral element 32 and the lower floor 33;
- fitting first male members 35 into the second fixing members 3114 passing through the second fixing members 3214 for assembling together the longitudinal element 31 and the lateral element 32;
- successively fitting the other longitudinal element 31 and the other lateral element 32 by proceeding in a similar manner to that described hereinabove;
- putting resin and then second male members 36 into the first fixing members 3311 for assembling together the longitudinal and lateral elements 31, 32 and the lower floor 33;
- fitting first male members 35 into the second fixing members 3114 passing through the second fixing members 3214 for assembling together the various longitudinal and lateral elements 31, 32;
- carrying out finishing work inside the dwelling unit 30, such as the cabling, the heating, the floor covering, etc.;
- fitting the upper floor 34 on the various longitudinal and lateral elements 31, 32 by bringing the shoulders 3112, 3212, 3412 into contact and by applying adhesive or resin beforehand to the contact surfaces;
- fitting third male members 37 into the first upper fixing members 3112, 3212 passing through the first and second fixing members 3413, 3414 for assembling together the various longitudinal and lateral elements 31, 32 and the upper floor 34;
- fitting fourth male members 38, preferably a threaded rod, passing through the third fixing members 3115 of each longitudinal element 31 and through the recesses 3313, 3415 respectively in the lower and upper floor 33, 34;
- fitting a distribution plate 39 and a female tightening member 40, advantageously a nut, at each end of the fourth male members 38 inside said recesses 3313, 3415;
- tightening each female member 40 with a torque wrench and fitting a member 41 for immobilizing said female member 40, preferably a locknut; and
- refilling the recesses 3313, 3415 in order to obtain flat surfaces on the lower and upper floors 33, 34.

It goes without saying that putting the dwelling unit together could start by positioning a lateral element 32 on the lower floor 33 without departing from the scope of the invention.

After producing the various dwelling units 30, the dwelling units 30, similar to the one described hereinabove, can then be assembled together by performing the following successive steps:

- placing two dwelling units 30 as close to one another as possible;
- fitting a sealing compound such as a closed-cell seal on the faces which will be in contact;
- fitting the assembly means simultaneously through the orifices in the lower floors 33 of each dwelling unit 30 and locking after fitting each end of said assembly means in order to adhesively bond the two dwelling units 30;
- fitting screwed mounting plates in the top part of the junction between the two dwelling units 30 in order to keep said units in position.

The present invention applies more particularly to the production of individual dwellings but it is clear that the example just given is only one particular illustration which is in no way limiting with regard to the fields of application of the invention.

The invention claimed is:

1. A prefabricated element for a dwelling unit made mainly of composite building material produced from crushed aggregate agglomerated with a binder, comprising:

- a vertical partition of approximately constant thickness and having a front face, a rear face and a peripheral face,
- a first flange along each horizontal edge of said front face,
- a second flange along each vertical edge of said front face,
- first and second ribs which are respectively vertical and horizontal and form with the first and second flanges a grid of cells filled with insulating materials and able to hold an interior trim concealing the entirety of said grid,
- a peripheral shoulder designed to transmit and distribute service loads and creating at least one bearing face and a sealing baffle, and
- at least first and second fixing members enabling various prefabricated elements to be assembled together,
- and wherein the vertical faces of the first and second flanges, the first and second ribs, which are approximately parallel to the front face of the partition, are covered with first battens for breaking the thermal bridge and fixing said interior trim and the insulating materials.

2. The prefabricated element as claimed in claim 1, wherein the partition, the first and second flanges, the first and second ribs and the shoulder are made of high performance concrete.

3. The prefabricated element as claimed in claim 1, wherein the first and second flanges and the first and second ribs have an overall rectangular cross section, protrude perpendicularly from the front face and have the same height.

4. The prefabricated element as claimed in claim 1, wherein each first batten forms an inverted T having a perforated central stalk embedded in said building material.

5. The prefabricated element as claimed in claim 4, wherein the first battens are made of a material selected from the group consisting of MDF and wood.

6. The prefabricated element as claimed in claim 1, wherein the insulating materials are preformed insulation blocks.

7. The prefabricated element as claimed in claim 1, wherein first and second fixing members are positioned respectively on the first and second flanges and, depending on the configuration, are female members or plain holes.

8. The prefabricated element as claimed in claim 1, wherein it comprises third fixing members.

9. The prefabricated element as claimed in claim 8, wherein the third fixing members are positioned along the second flanges and enable the composite building material to be post-stressed.

10. The prefabricated element as claimed in claim 8, wherein the third fixing members are tubes inserted vertically into the second flanges enabling the subsequent fitting of a threaded rod for assembling said vertical prefabricated element between two other similar prefabricated elements which are horizontal.

11. A dwelling unit made mainly of composite building material, comprising two longitudinal elements, two lateral elements, a lower floor and an upper floor, wherein said longitudinal and lateral elements, lower floor and upper floor comprise:

a vertical partition of approximately constant thickness and having front face, a rear face, and a peripheral face;

a first flange along each horizontal edge of said front face, a second flange along each vertical edge of said front face, first and second ribs which are respectively vertical and horizontal and form with the first and second flanges a grid of cells filled with insulating materials and able to hold an interior trim concealing the entirety of said grid;

a peripheral shoulder designed to transmit and distribute service loads and creating at least one bearing face and a sealing baffle; and at least first and second fixing members enabling various prefabricated elements to be assembled together, wherein the vertical faces of the first and second flanges and the first and second ribs, which are approximately parallel to the front face of the partition, are covered with first battens for breaking the thermal bridge and fixing said interior trim and the insulating material.

12. The dwelling unit as claimed in claim 11, wherein the first and second fixing members are able to engage with first, second and third male members in order to assemble together the longitudinal and lateral elements and the lower and upper floors.

13. The dwelling unit as claimed in claim 11 wherein the two longitudinal elements comprise third fixing members.

14. The dwelling unit as claimed in claim 13 wherein the lower floor and the upper floor respectively comprise recesses able to engage with said third fixing members and enabling the fitting of fourth male members, distribution plates, female tightening members and members for immobilizing said female members in order to perform post-stressing.

15. The dwelling unit as claimed in claim 11, wherein the peripheral shoulder of the lower floor forms a flat bearing zone and continues all the way round the periphery of said lower floor.

16. The dwelling unit as claimed in claim 11, wherein the peripheral shoulder of the upper floor is a continuation of the end of the first and second flanges in a direction perpendicular to said partition, said shoulder being able to engage with the upper part of the shoulders of said longitudinal and lateral elements.

17. The dwelling unit as claimed in claim 14, further comprising:

fourth male members fitted in said recesses;

distribution plates seated on said fourth male members and contacting said recesses;

female tightening members engaging said fourth male members for securing said distribution plates between said female tightening members and said recesses; and members for immobilizing said female members on said fourth male members.

18. The dwelling unit as claimed in claim 17, wherein the fourth male members are threaded rods.

* * * * *